US005279015A

United States Patent [19]

Meiring

[11] Patent Number: 5,279,015

[45] Date of Patent: Jan. 18, 1994

[54] DUSTER

[76] Inventor: Hercules A. Meiring, Vaal Eden, Parys District, Orange Free State, South Africa

[21] Appl. No.: 984,248

[22] Filed: Nov. 30, 1992

Related U.S. Application Data

[63] Continuation of Ser. No. 780,866, Oct. 18, 1991, abandoned.

[30] Foreign Application Priority Data

Oct. 19, 1990 [GB] United Kingdom ..... 9022830

[51] Int. Cl.[5] ..... A47K 7/02; A47L 13/38

[52] U.S. Cl. ..... 15/244.1; 15/225; 15/229.2; 15/234

[58] Field of Search ..... 15/146, 147R, 159.1, 173, 174, 225, 226, 228, 229.1, 229.2, 229.6, 244.1, 244.2, 244.4, 230.16, 234; 428/397, 428/399

[56] References Cited

U.S. PATENT DOCUMENTS

| | | | |
|---|---|---|---|
| 48,232 | 6/1865 | Bolender | 15/173 |
| 907,338 | 12/1908 | Goodhue | 15/234 |
| 1,033,898 | 7/1912 | Isham | 15/234 |
| 1,757,853 | 5/1930 | Carbone | 15/229.1 |
| 1,841,228 | 1/1932 | Veeder | 15/123 |
| 1,962,675 | 6/1934 | Zentmyer | 15/229.1 |
| 1,968,303 | 7/1934 | McMath | 15/244.2 |
| 2,214,989 | 9/1940 | Brand | 15/234 |
| 3,118,161 | 1/1964 | Cramton | 151/159.1 |
| 3,162,880 | 12/1964 | Francis | 15/234 |
| 3,199,139 | 8/1965 | Uallis | 15/244.1 |
| 3,204,277 | 9/1965 | Uisman | 15/244.1 |
| 3,251,729 | 5/1966 | Shaw | 428/399 |
| 3,281,889 | 11/1966 | Feil | 15/244.1 |
| 3,312,583 | 4/1967 | Rochlis | 15/159 A |
| 3,983,596 | 10/1976 | Siemund | 15/244.1 |
| 4,114,224 | 9/1978 | Disko | 15/229.1 |
| 4,135,272 | 1/1979 | Stephenson | 15/147.1 |
| 4,381,325 | 4/1983 | Masudo | 428/399 |
| 4,550,468 | 11/1985 | Nelson | 15/147 R |
| 4,937,141 | 6/1990 | Burns | 15/159 A |
| 5,027,468 | 7/1991 | Leventhal | 15/229.1 |

FOREIGN PATENT DOCUMENTS

| | | | |
|---|---|---|---|
| 17050/34 | 4/1934 | Australia . | |
| 453817 | 12/1949 | Italy | 15/225 |
| 1147514 | 6/1983 | Japan | 15/234 |
| 271157 | 12/1986 | Japan | 15/230.16 |

*Primary Examiner*—Philip R. Coe
*Assistant Examiner*—Terrence R. Till
*Attorney, Agent, or Firm*—Ladas & Parry

[57] ABSTRACT

There is disclosed a duster (130) comprising a foamed synthetic plastics material formed to have a plurality of slender, tentacles (24).

13 Claims, 3 Drawing Sheets

DUSTER

This is a continuation of copending application Ser. No. 07/780,866 filed On Oct. 18, 1991, abandoned.

This invention relates to a duster.

In accordance with the invention, there is provided a duster comprising an elongate handle;

a plurality of tentacles which are of a foamed synthetic plastics material and which are attached to the handle at one end thereof, each tentacle having a base proximate a position where it is attached to the handle and an opposed, free end, each tentacle tapering from the base to the free end such that a cross-sectional area at the free end is at most half of a cross-sectional area at the base; and a collar extending around the tentacles in the region of their bases and bunching the tentacles together to cause them to extend generally longitudinally with the handle.

In one embodiment, the tentacles, at their bases, may be integral with a foundation strip which is wrapped around the handle. Instead, separate tentacles may be attached to a foundation strip which is then wrapped around the handle.

In another embodiment, which is preferred, the tentacles may be separate, may be arranged around and may be tied to the handle.

The collar may be of frusto-conical shape.

Advantageously, the duster may include a spreader arranged generally centrally amidst the tentacles in the region of the collar such as to urge the tentacles outwardly against the collar. This arrangement has the advantage that a relatively small number of tentacles can be located so as to be directed in a desired fashion, e.g. skirt-like formation. The spreader may be of foamed synthetic plastics material, e.g. of the same material as the tentacles. Waste material may be used for this purpose.

The foamed synthetic plastics material may advantageously be of polyurethane.

The invention is now described by way of example with reference to the accompanying diagrammatic drawings. In the drawings FIG. 1 shows, in three dimensional view, a block of material from which tentacles of a duster in accordance with the invention are formed;

Figure 1:
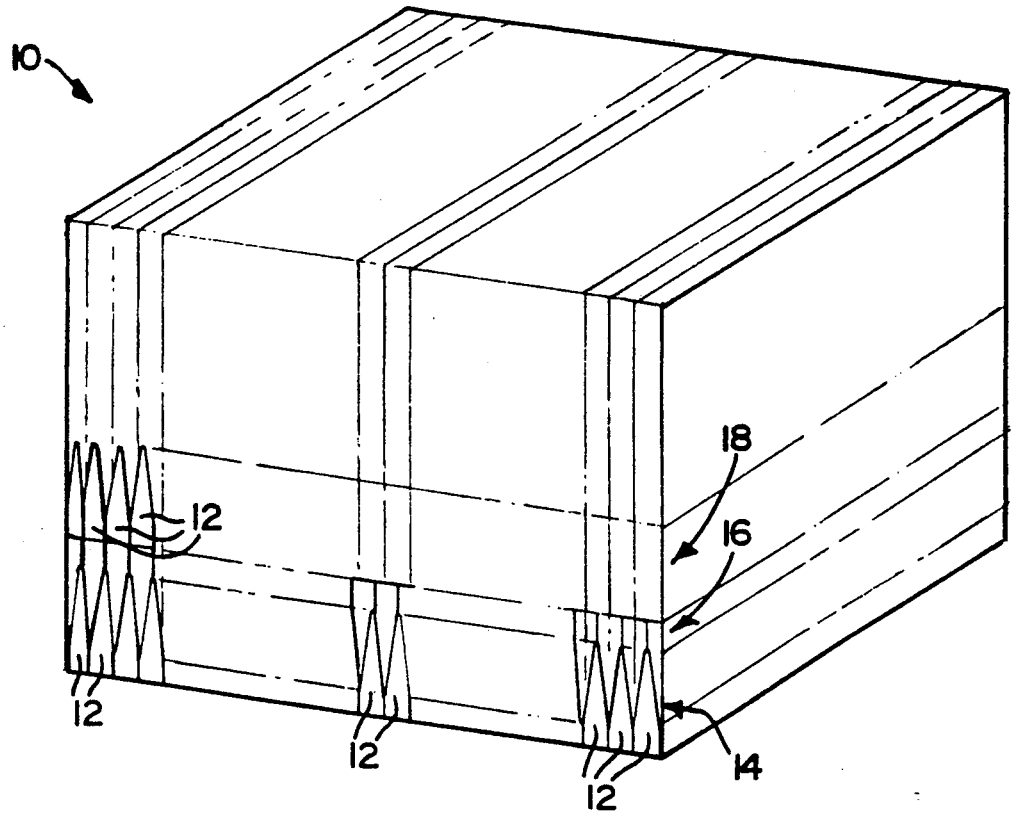

With reference to the drawings generally, tentacles for a duster in accordance with the invention are of synthetic plastics material, more specifically a suitable grade of foamed polyurethane material. With reference to FIG. 1, a block of such foamed polyurethane material is generally indicated by reference numeral 10. By means of a profile cutter, or the like, in a first layer 14 of the block 10, a plurality of strips 12 (which can best be perceived from FIG. 2) are cut in a first orientation. Correspondingly, from a second layer 16, a plurality of similar strips 12 are cut in opposite orientation. A third layer 18 is dealt with in a fashion similar to the layer 14, and the like. In this fashion, not only is material used optimally, but also cutting is minimized.

Figure 2:
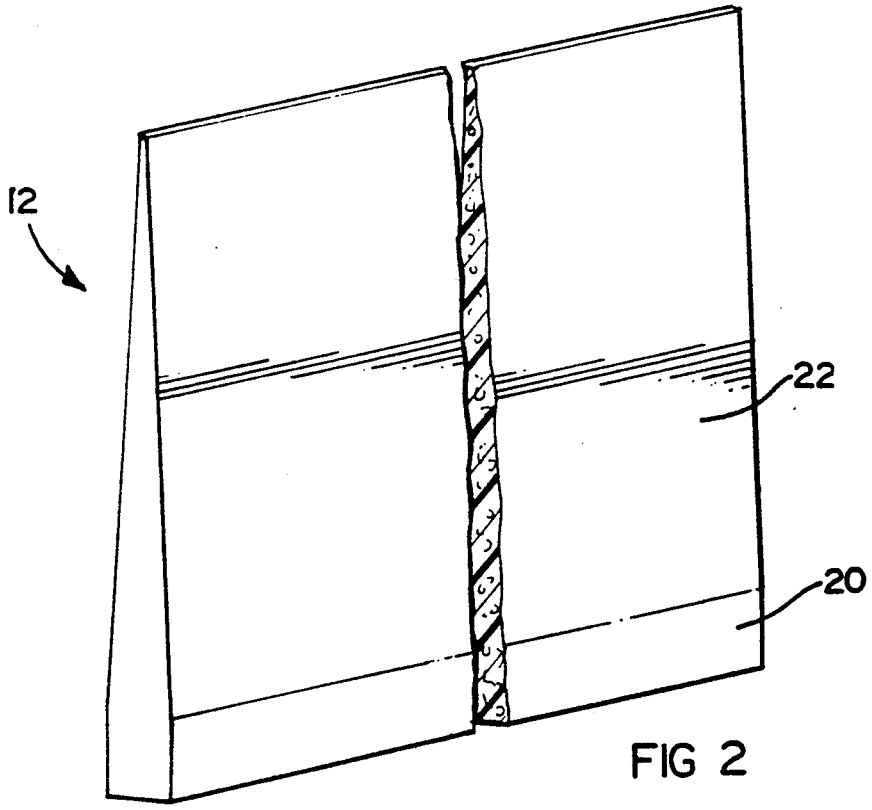
FIG. 2 shows, in three dimensional view, to an increased scale, a strip of material cut from the block of FIG. 1.

With reference to FIG. 2, one of the strips 12 is shown in more detail. The strip 12 has a parallel base 20 and an integral wedge-shaped portion 22.

Figure 3:
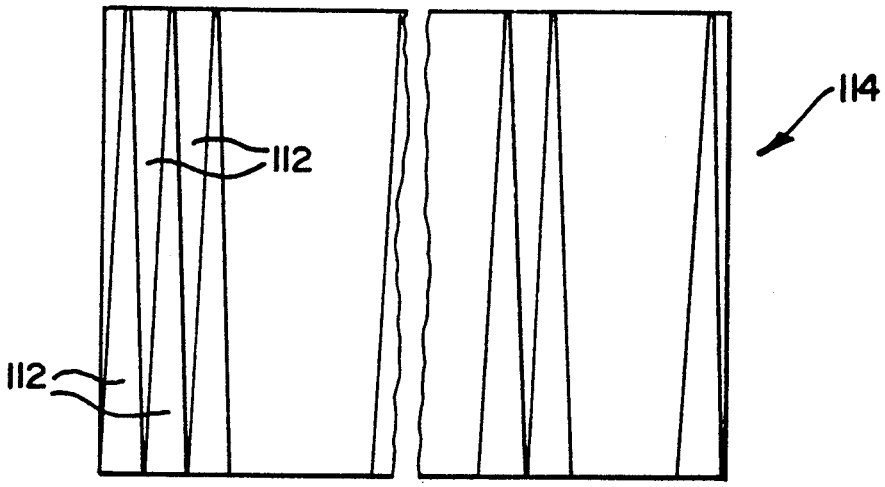
FIG. 3 shows, in end elevation, to an intermediate scale, another way of cutting strips similar to the strip of FIG. 2 from a block of material.

With reference to FIG. 3, another way of cutting strips to form tentacles is shown. Only one layer 114 is shown from which two sets (respectively in opposed orientation) of strips 112 are cut. Each strip 112 is merely of wedge-shape similar to the wedge-shaped portion 22 i.e. it does not have the parallel base 20. The strips 112 and the method of cutting them are simpler than the strip 12 and the method of cutting as shown in FIG. 1 and can easily be perceived from FIG. 3.

Figure 4:
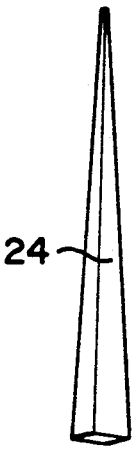
FIGS. 4 and 5 show, in three dimensional views, two embodiments of tentacles cut from a strip of material cut in accordance with FIG. 3.

With reference to FIG. 4, from a strip 112 a tentacle such as the tentacle 24 can be cut. It is to be appreciated that the tentacle is pyramidal-shaped i.e. apart from the wedge-shaped profile of the strip 112, it is further cut in wedge-shape seen from a 90° different angle, i.e. it is formed by oblique cuts through the thickness of the strip 112. This results in a tentacle having the pyramidal-shape as shown in FIG. 4 i.e. a relatively broad base of generally square section and a thin, pointed opposed end.

Figure 5:
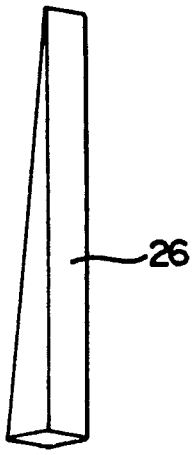

Alternatively, with reference to FIG. 5, when the individual tentacles are cut from the strip 112, the cut lines through the thickness of the strip 112 can be parallel which results in tentacles as shown in FIG. 5 having, seen from one side a wedge-shape, and seen from a 90° different angle a parallel shape. The tentacles of FIG. 5 can be cut with no wasted material. However, it is to be appreciated that the tentacle 5 contains more material than the tentacle 4 and generally the same number of tentacles (regardless of whether they are in accordance with FIG. 4 or with FIG. 5) can be cut from similar strips.

For a general purpose duster, the tentacles 24, 26 may be of the order of 200 mm long and may have a maximum cross-sectional dimension of about 10 mm. The minimum cross-sectional dimension i.e. at the smaller end may be about 1 mm to 2 mm. These quantitative dimensions are given by way of example only and it is to be appreciated that the tentacles will be dimensioned bearing in mind the intended purpose of the duster.

In one embodiment, suitable for dusting large surfaces such as walls, ceilings, and generally robust objects such as exterior furniture and the like, the tentacles may have a cross-sectional dimension at their bases of typically 5 mm to 20 mm, and may have a length of typically 10 cm to 30 cm. The material may have a coarse open cell texture.

In another embodiment, suitable for dusting smaller surfaces and more delicate objects, such as for general interior use, the tentacles may be thinner and shorter and the texture of the material may be finer.

In yet a further embodiment suitable for use in dusting delicate objects such as chinaware, silverware, and the like, the tentacles may be even thinner.

The length and resilience of the tentacles may be selected bearing in mind the intended use of the duster. Thus, for heavy duty such as in dusting of clinging dust and grime, the tentacles may be relatively stiff and thus also relatively short. In contrast, for light duty such as for dusting delicate objects, the tentacles may be relatively compliant and thus relatively long.

The material of which the tentacles are made will be selected bearing in mind the intended duty. Thus, for general interior use, a relatively inexpensive foamed material may be suitable. On the other hand, for heavy duty, a suitable polyurethane composition may be required. Generally, of materials currently available, the Applicant favours flexible polyurethane foamed material.

Figure 6:
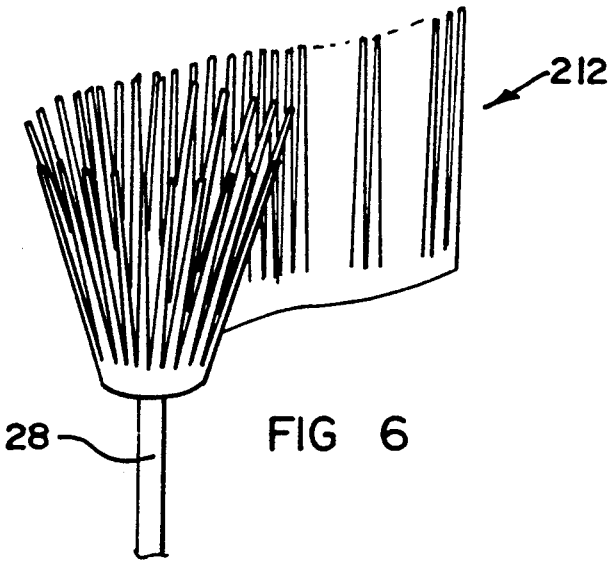
FIG. 6 shows, in three dimensional view, to a small scale, one embodiment of forming a duster in accordance with the invention.

With reference to FIG. 6, a duster is shown being formed of a strip 12 in a specifically cut form as indicated by reference numeral 212. The strip 12 is cut to form tentacles, similar to the tentacle 24 or 25, in the wedge portion 24 while they remain intact to the base 12. Thus, the intact base portion of the cut strip 212 is wound around a handle 28 and is tied to the handle 28. Instead, if the tentacles are cut to be separate, a plurality of tentacles may be attached to a base strip to form a composite strip similar to the strip 12 which can then be attached to the handle in similar manner.

Figure 7:
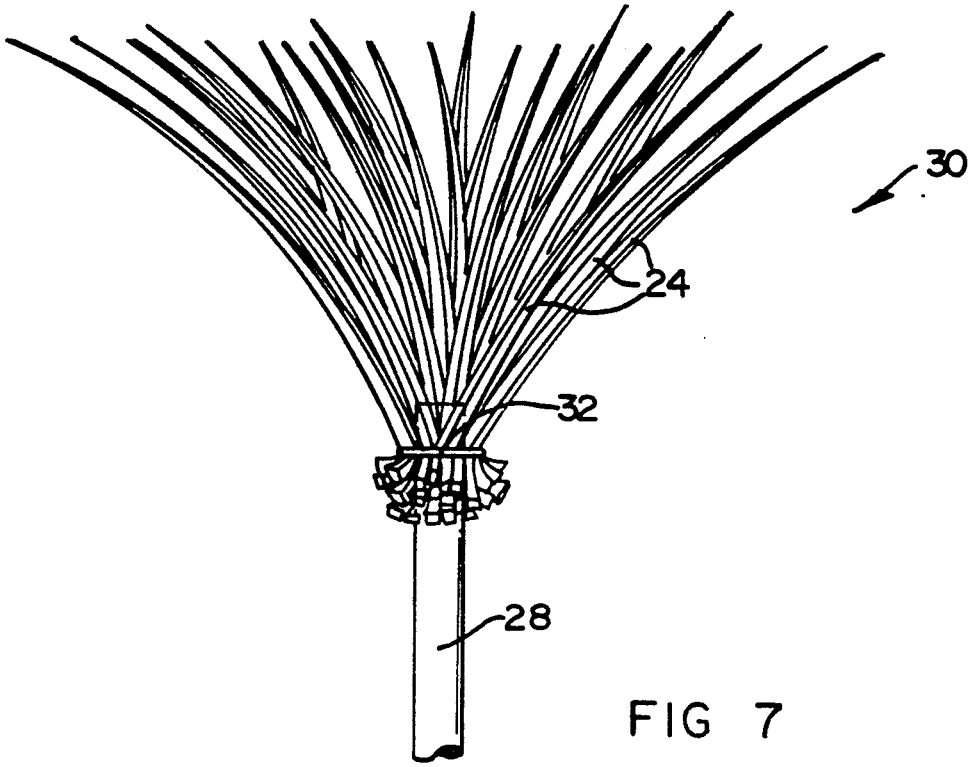
FIG. 7 shows, in frontal elevation, to a slightly larger scale, another, unfinished, embodiment of a duster in accordance with the invention.

However, with reference to FIG. 7, in a more preferred embodiment, the tentacles such as the tentacles 24 are separate, and are bundled together around one end of the handle 28 where they are tied by means of a tie 32. The Inventor has found that a flexible synthetic plastics tie having ratchet-type teeth and a complemental collar to allow it to be tightened and to be locked in such a tightened condition can advantageously be used as a tie 32. Such ties are widely used, for example, by electricians when tying electrical conductors to one another or to substrates. The duster shown in FIG. 7 by reference numeral 30 is only partially finished as it is still to receive a collar similar to the collar which will be described with reference to FIG. 8.

Figure 8:
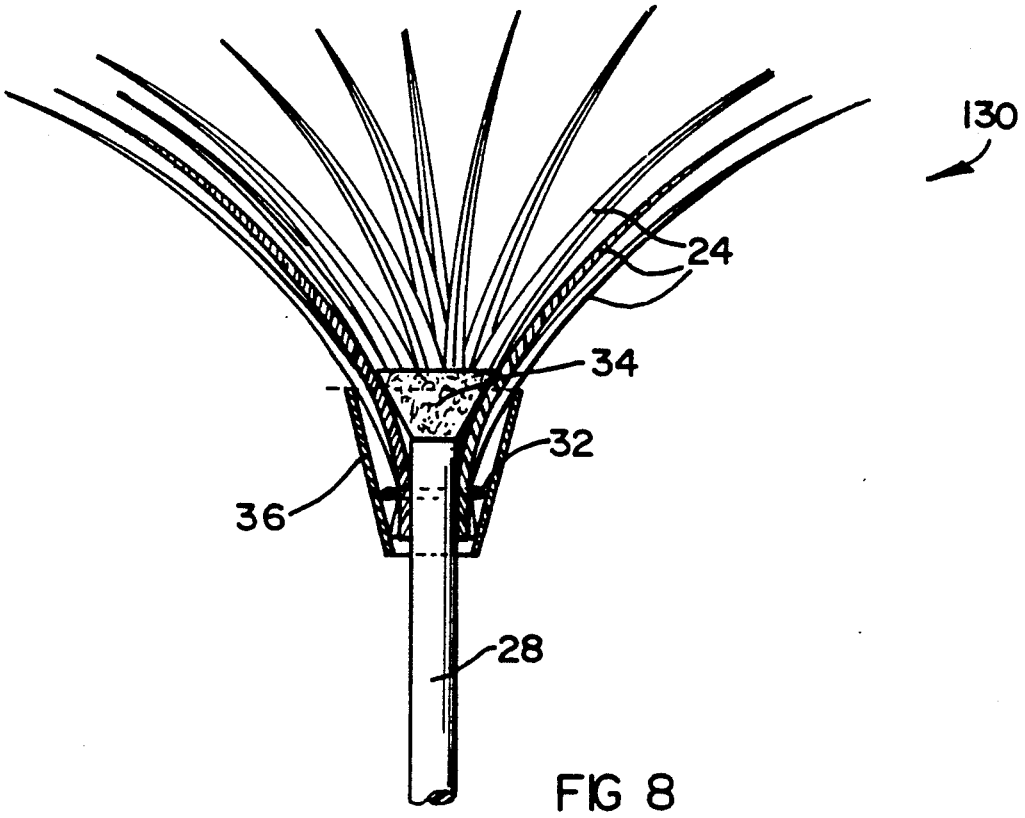
FIG. 8 shows in part sectional frontal elevation, a preferred embodiment of a duster in accordance with the invention.

In FIG. 8, a most preferred duster is indicated by reference numeral 130. It is similar to the duster of FIG. 7 except that a central spreader 34 is positioned amongst the tentacles 24 in the vicinity of the end of the handle 28. The spreader 34 spreads the tentacles 24 slightly outwardly, skirt-fashion.

In addition, a collar 36 is provided around the tied bases of the tentacles 24 to direct the tentacles 24 generally longitudinally with the handle 28 by bunching or choking the tentacles together around the spreader 34. The collar 36 also gives a neat appearance. In the embodiment of FIG. 8, the tentacles 24 are guided from the outside by the collar 36 and from the inside by the spreader 34 to form a neat conically-shaped duster. The spreader 34 is conveniently of a flexible material. Advantageously waste material obtained from the bulk material from which the tentacles are cut can be used.

It is to be appreciated that, although the embodiments of FIG. 7 and 8 have conveniently been described utilizing the tentacle 24 of FIG. 4, they could likewise use the tentacle 26 of FIG. 5.

Conveniently, a loop may be provided at the end of the handle remote from the end having the tentacles, to suspend the duster from a hook or the like when not in use.

It is a first advantage that foamed material has been found by the Inventor to remove dust well. Thus, a duster in accordance with the invention is expected to be very effective in removing dust.

It is a second advantage that a duster in accordance with the invention can easily be cleaned by washing the duster head in soap and water, or other suitable cleaning liquid.

It is a further advantage that a duster can be manufactured for a specific purpose or duty as described above. The invention is thus very versatile in providing different dusters for different duties or conditions. In this regard, it is to be appreciated that a wide variety of materials is available from which proper selection can be made, although, as mentioned above, the Applicant currently favours a suitable grade of flexible polyurethane foamed material.

It is a further advantage that, especially for unsophisticated uses, the material for manufacturing the duster head can be relatively inexpensive and the duster can be produced correspondingly inexpensively.

The Applicant has found that foamed synthetic plastics material can very effectively be used in dry conditions to remove dust, grime, and the like. This is in contrast to the conventional use of foamed synthetic plastics material for cleaning purposes in which the synthetic plastics material is used predominantly as a carrier for a wet detergent like soapy water and the like. It is thus a fundamental difference between the current invention and known uses of foamed synthetic plastics material for cleaning purposes that the duster in accordance with the invention is used in dry condition. The Inventor has found that dust and other particles can be dislodged very effectively by means of the foamed synthetic plastics tentacles and that dusting is correspondingly very effective.

I claim:

1. A duster comprising an elongate handle;

a plurality of tentacles made of an open cell, flexible, synthetic plastics and which are attached to the handle at one end thereof, each tentacle having a base proximate a position where it is attached to the handle and an opposed free end, each tentacle tapering from the base to the free end such that a cross-sectional area at the free end is at most half of a cross-sectional area at the base; and a collar extending around the tentacles in the region of their bases and bunching the tentacles together to cause them to extend generally longitudinally relative to the handle and beyond said one end of the handle, the duster being suitable for use in dry conditions to dislodge and move dust from a surface having an attitude which may range from upwardly facing horizontal through vertical to downwardly facing horizontal, by moving said one end of the handle with clearance past the surface, the clearance being less than an effective length of extension of the tentacles, the tentacles being sufficiently compliant to bend such as to be decumbent with the surface, the tentacles being sufficiently resilient to be self-supporting such that, when the duster is held upright, a free end portion of each tentacle will extend beyond said one end of the handle to which the tentacles are secured.

2. A duster as claimed in claim 1 in which the tentacles, at their bases, are integral with a foundation strip which is wrapped around the handle.

3. A duster as claimed in claim 1 in which the tentacles are separate, are arranged around the are tied to the handle.

4. A duster as claimed in claim 1 in which the collar is of frusto-conical shape, the duster including a spreader arranged generally centrally amidst the tentacles within the collar, the spreader having an outer surface which is substantially frusto-conical in use to co-operate with the collar to define a diverging annular passage within which the tentacles are located.

5. A duster as claimed in claim 1 which includes a spreader arranged generally centrally amidst the tentacles within the collar, the spreader having an outer surface, and a compliance substantially the same as the material of the tentacles, to allow compliant deformation in its outer surface such as to urge the tentacles outwardly against the collar.

6. A duster as claimed in claim 5 in which the spreader is of foamed synthetic plastics materials.

7. A duster as claimed in claim 5 in which the material of the spreader is the same as the material of the tentacles.

8. A duster as claimed in claim 1 in which the foamed synthetic plastics material is of polyurethane.

9. A duster as claimed in claim 1, comprising a tie member engaged around said tentacles at said bases thereof to secure said tentacles to said handle, a conical spreader arranged substantially centrally within the tentacles adjacent to said handle to urge the tentacles outwardly as the tentacles exit from said tie member, said collar being hollow and conical and surrounding said handle at said one end thereof and the bases of the tentacles and said tie member, said collar increasing in diameter in a direction away from said handle to a level surrounding said conical spreader to bunch the tentacles together between said spreader and said collar.

10. A duster as claimed in claim 9, wherein said spreader has a greater cone angle than said collar.

11. A duster as claimed in claim 10, wherein said spreader extends beyond said collar.

12. A duster as claimed in claim 11, wherein said collar encloses the bases of said tentacles and extends therebeyond to an end of smallest diameter which surrounds said handle.

13. A duster as claimed in claim 12, wherein the spreader is made from the same synthetic plastics as said tentacles.

* * * * *